United States Patent [19]

Yamada et al.

[11] Patent Number: 4,840,037

[45] Date of Patent: Jun. 20, 1989

[54] REFRIGERATOR WITH COLD ACCUMULATION SYSTEM

[75] Inventors: Koji Yamada; Noriaki Sakamoto, both of Ibaraki, Japan

[73] Assignee: Kabushiki Kaisha Toshiba, Kawasaki, Japan

[21] Appl. No.: 153,712

[22] Filed: Feb. 8, 1988

[30] Foreign Application Priority Data

Feb. 27, 1987 [JP] Japan ..... 62-029077[U]

[51] Int. Cl.[4] ..... F25B 5/00

[52] U.S. Cl. ..... 62/199; 62/157; 62/231; 62/185; 62/229

[58] Field of Search ..... 62/199, 200, 157, 231, 62/333, 332, 334, 335, 185, 229, 186, 208, 209, 203

[56] References Cited

U.S. PATENT DOCUMENTS

| | | | |
|---|---|---|---|
| 2,576,663 | 11/1951 | Atchison | 62/199 |
| 3,603,379 | 9/1971 | Leonard, Jr. | 62/333 X |
| 4,406,138 | 9/1983 | Nelson | 62/185 X |
| 4,439,998 | 4/1984 | Horvay et al. | 62/199 |
| 4,634,046 | 1/1987 | Tanaka | 62/231 X |

FOREIGN PATENT DOCUMENTS 53-10586 3/1978 Japan .

*Primary Examiner*—Harry B. Tanner

*Attorney, Agent, or Firm*—Cushman, Darby & Cushman

[57] ABSTRACT

A cold-accumulation type refrigerator having variable length cycle for cooling by means of the cold-accumulation material. The cycle length is a function of refrigerator load. The refrigerator includes a refrigerating cycle to cool a refrigerator compartment and the cold-accumulation material, a load detecting device, such as a room temperature detecting device, to measure an amount of a load to be cooled, clock counting device to generate a time data, and a control device, such as microcomputer. The control device controls the operation of the refrigerator which operates in a first mode (ordinary cooling operation), a second mode wherein the refrigerator compartments are cooled by means of the cold accumulation material and a third mode wherein the cold accumulation material is cooled. The control device controls the time period for second and third mode operation as a function of load to be cooled.

14 Claims, 4 Drawing Sheets

REFRIGERATOR WITH COLD ACCUMULATION SYSTEM

BACKGROUND OF THE INVENTION

1. Field of the Invention

The present invention relates, in general, to refrigerators. More particularly, the invention relates to a cold-accumulation type refrigerator using cold-accumulation material to cool the interior of a refrigeration compartment.

2. Description of the Prior Art

It is known to provide a refrigerator with a cold-accumulation material in order to enhance the cooling capacity of a refrigerating cycle. An example of such a cold-accumulation type refrigerator is disclosed in Japanese Utility Model Publication No. 53-10586, filed on Oct. 9, 1973 in the name of Kenichi KAGAWA. According to Japanese Utility Model Publication No. 53-10586, an auxiliary evaporator and an auxiliary condenser are placed within a case containing the cold-accumulation material. The auxiliary evaporator and auxiliary condenser are connected in parallel fluid circuit relation with each other in order to increase the operating efficiency of the refrigerating cycle, especially the operating efficiency of a compressor.

Recently, there has been consideration of the use in refrigerators of cold-accumulation materials to even out the power demand during a 24-hour day by utilizing power which is not effectively used, such as night-time power. One such refrigerator is constituted as follows.

A main evaporator is provided for cooling refrigerator compartments and a cold-accumulation evaporator is provided for cooling the cold-accumulation material. A time-controlled changeover device selectively changes the operating mode of the refrigerator. In a first mode of operation (ordinary cooling mode), refrigerant is supplied to a main evaporator to cool the refrigerator compartments. In a second mode of operation, the refrigerator compartments are cooled by the cold accumulation material. In a third mode of operation, the cold accumulation material is cooled by the cold-accumulation evaporator. The cold-accumulation material is installed in a manner permitting it to be cooled by the cold-accumulation evaporator. A thermosiphon is provided in a manner permitting transfer of heat between the main evaporator and the cold-accumulation material. The thermosiphon is constituted by a closed-loop pipeline enclosing an operating liquid therein, such as a refrigerant. In the middle of the night when there is little demand for power, the cold-accumulation material is thoroughly cooled by the cold-accumulation evaporator. For a predetermined time period during the day, when there is greater power demand, refrigerator compartments are cooled by second mode operation, i.e. refrigeration is by means of the cold-accumulation material instead of by first mode operation, i.e. ordinary cooling operation, which requires a large amount of power. During second mode cooling the thermosiphon exchanges heat between the cold-accumulation material and the main evaporator. A compressor, which supplies refrigerant to the main evaporator during first mode cooling and consumes most of power required by the refrigerator, is not operated. Therefore second mode cooling requires less power to cool the refrigerator compartments than first mode cooling.

However, with this type of refrigerator, if a refrigerator compartment door is opened and closed when the room temperature is high, as, for example, in summer, the temperature in that compartment rises due to high-temperature room air flowing into the compartment. This causes the cold-accumulation material cooling operation to be required frequently during the day time period assigned for second mode cooling.

In contrast, when the room temperature is colder, such as, for example, in winter, the amount of temperature rise in each compartment is small even when the refrigerator compartment doors are frequently opened and closed. As a result, the cold-accumulation material cooling operation is only carried out a small number of times during the day time period assigned for second mode cooling. Thus, the frequency of execution of second mode cooling varies because of the effects of room temperature. If the refrigerator is arranged so that the compartments are cooled by second mode cooling operation only for a predetermined time period of fixed length, the cold-accumulation material may still have remaining cooling capacity even when the end of the predetermined time period is reached (such as in winter). Despite the remaining excess cooling capacity, the cooling of the cold-accumulation material (third mode operation) is carried out for its predetermined length of time (at night) even though it probably does not require the same amount of cooling that it would require if all of its cooling capacity had been exhausted, such as in summer. This is wasteful.

On the other hand, if an excessively long time period is set for second mode cooling, the cooling capacity of the cold-accumulation material may be used up before the end of the time period assigned for second mode cooling is finished. This would run counter to the object making the power demand even over the course of a 24-hour day.

Thus far, the arrangements of cold-accumulation type refrigerators have not taken into account the effects of room temperature. Therefore, they have not made fullest use of the cooling capacity of the cold-accumulation material.

SUMMARY OF THE INVENTION

It is an object of the present invention to provide a refrigerator which is able to better evened out power demand during a 24-hour day.

It is another object of the present invention to more efficiently and effectively use the cooling capacity of a cold-accumulation material in a refrigerator.

To accomplish the objects described above, the present invention provides a refrigerator with a cold-accumulation material including a refrigerating cycle, a load detecting device, a clock counting device, and a control device.

The refrigerating cycle includes means for cooling the refrigerator compartments and means for cooling the cold-accumulation material. The load detecting device measures an amount of a load to be cooled. The clock counting device generates time data, and in accordance with this time data, the control device causes the refrigerator to operate in accordance with any of three modes of operation:

First Mode: In first mode (also known as an ordinary cooling mode) operation, refrigerator compartments are cooled by a main evaporator in accordance with a normal refrigeration cycle.

Second Mode: In second mode operation, refrigerator compartments are cooled by heat transfer between the compartments and the cold-accumulation material.

Third Mode: In third mode operation the cold accumulation material is cooled by a cold-accumulation material evaporator.

The control device controls the timing of the various modes of operation in accordance with the amount of load detected by the loading detecting device so as to make the best use of the cold-accumulation material.

BRIEF DESCRIPTION OF THE DRAWINGS

The invention will be described in greater detail with reference to the accompanying drawings in which.

DETAILED DESCRIPTION OF THE PREFERRED EMBODIMENT

A presently preferred exemplary embodiment of the invention will be described in detail with reference to the accompanying drawings.

Figure 3:
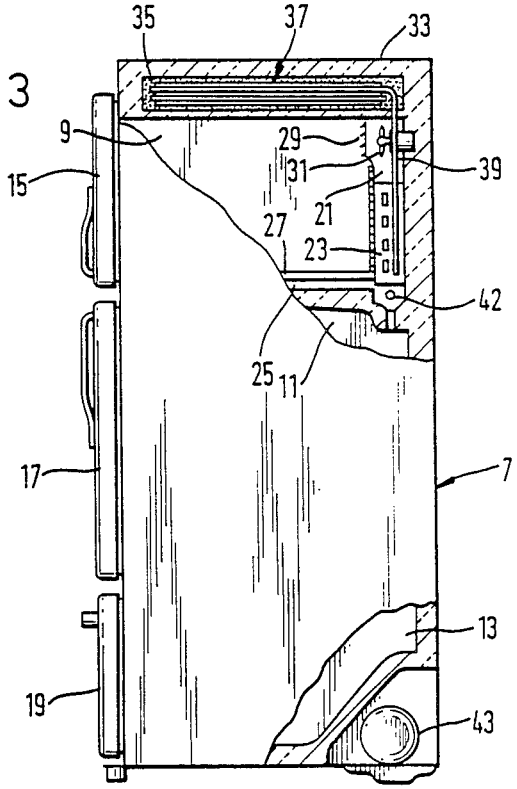
FIG. 3 is a side elevation, partly in section, of an embodiment of the present invention.
Figure 4:
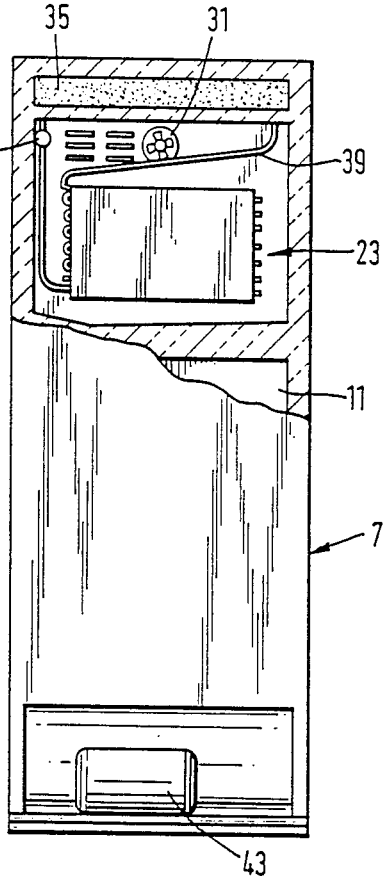
FIG. 4 is an elevation, partly in section, of an embodiment of the present invention.
Figure 5:
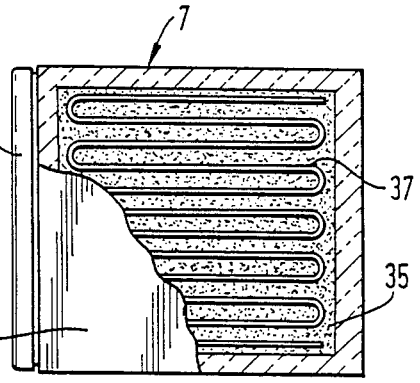
FIG. 5 is an enlarged view partly in section of an embodiment of the present invention.

The overall construction of the refrigerator, according to the invention, is shown in FIGS. 3–5. The interior of a main body 7 of the refrigerator is divided into a freezing compartment 9 above, a refrigerating compartment 11 in the middle, and a vegetable compartment 13 below. To the front of compartments 7, 9, and 11 are attached adiabatic doors 15, 17, 19, respectively. At the rear of freezing compartment 9, there is formed a main evaporator compartment 21 which is separated from the freezing compartment 9. The main evaporator compartment 21 has a main evaporator 23 in it. The interior of main evaporator compartment 21 communicates with the interior of the freezing compartment 9 through a return duct 25 formed in a heat insulation wall 27 constituting a partition between the freezing compartment 9 and the refrigerating compartment 11, and also through a cold air supply port 29 formed in an upper portion of the main evaporator compartment 21. A cold air circulation fan 31 is provided to the rear of the cold air supply port 29. Fan 31 pushes cold air produced by the main evaporator 23 into the freezing compartment 9 through the cold air supply port 29, while air inside the freezing compartment 9 passes through the return duct 25 to return to the main evaporator compartment 21. Cold air produced by the main evaporator 23 is also pushed into the refrigerating compartment 11 through an air supply port of a supply duct (not shown) formed in a rear heat insulation wall, while air inside the refrigerating compartment 11 passes through the interior of the vegetable compartment 13 and the return duct 25 to return to the main evaporator compartment 21. The air supply port of a supply duct (not shown) is provided with a damper (not shown) to control the temperature in the refrigerating compartment 11.

Figure 2:
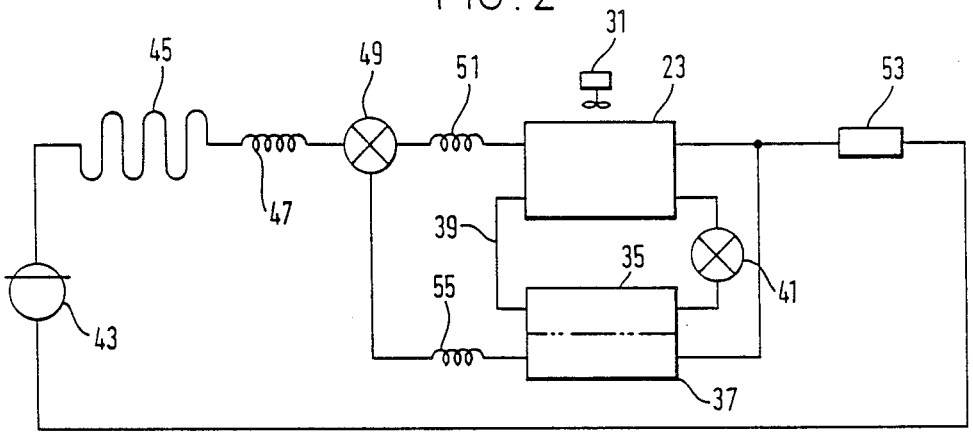
FIG. 2 is a schematic diagram of a refrigerating cycle according to an embodiment of the present invention.

As shown in detail in FIG. 5, in a ceiling surface portion 33 of the refrigerator main body 3, there is provided the cold-accumulation material 35 which is enclosed in heat insulating material and has the cold-accumulation evaporator 37 embedded in it. A thermosiphon 39 provided with a electromagnetic valve 41, as shown in FIG. 4, connects the cold-accumulation evaporator 37 to the main evaporator 23 in a manner permitting transfer of heat as described below. The thermosiphon 39 is constituted by a closed loop pipeline which has operating fluid, such as, e.g. refrigerant, therein. The portions of the closed loop pipeline next to the main evaporator 23 and the cold-accumulation evaporator 37 are zig-zag shaped so as to enhance heat exchange. A glass-tube defrosting heater 42 is provided below the main evaporator 23 for periodic defrosting. The refrigerating cycle will be described with reference to FIG. 2. The discharge side of a compressor 43 is connected through a condenser 45 and a first capillary tube 47 to an inflow side of a flowpath switching type electromagnetic valve 49. Valve 49 has two outflow ports. A first of the two outflow ports connects through a second capillary tube 51 to an inflow port of the main evaporator 23. A second of the two outflow ports connects through a third capillary tube 55 to an input of the cold accumulation evaporator 37. An outflow port of the main evaporator 23 connects through an accumulator 53 to an intake side of the compressor 43, whereby there is established a refrigerant flow path for ordinary cooling operation (first mode) to cool the main evaporator 23 and hence the interior of the compartments.

Cold-accumulation evaporator 37 is connected in parallel with the main evaporator 23 to the accumulator 53, whereby there is established a refrigerant flow path for cold-accumulation mode operation (third mode) for cooling the cold-accumulation evaporator 37 and hence the cold-accumulation material 35. As noted above, the thermosiphon 39 is thermally connected between the main evaporator 23 and the cold-accumulation evaporator 37, and hence the cold-accumulation material. It is arranged in such a way that a cold-accumulation material cooling operation can be effected, in which the main evaporator 23 and hence the interior of compartments are cooled by exchange of heat between the main evaporator 23 and the cold-accumulation material 35 when the electromagnetic valve 41 is opened.

Figure 1:
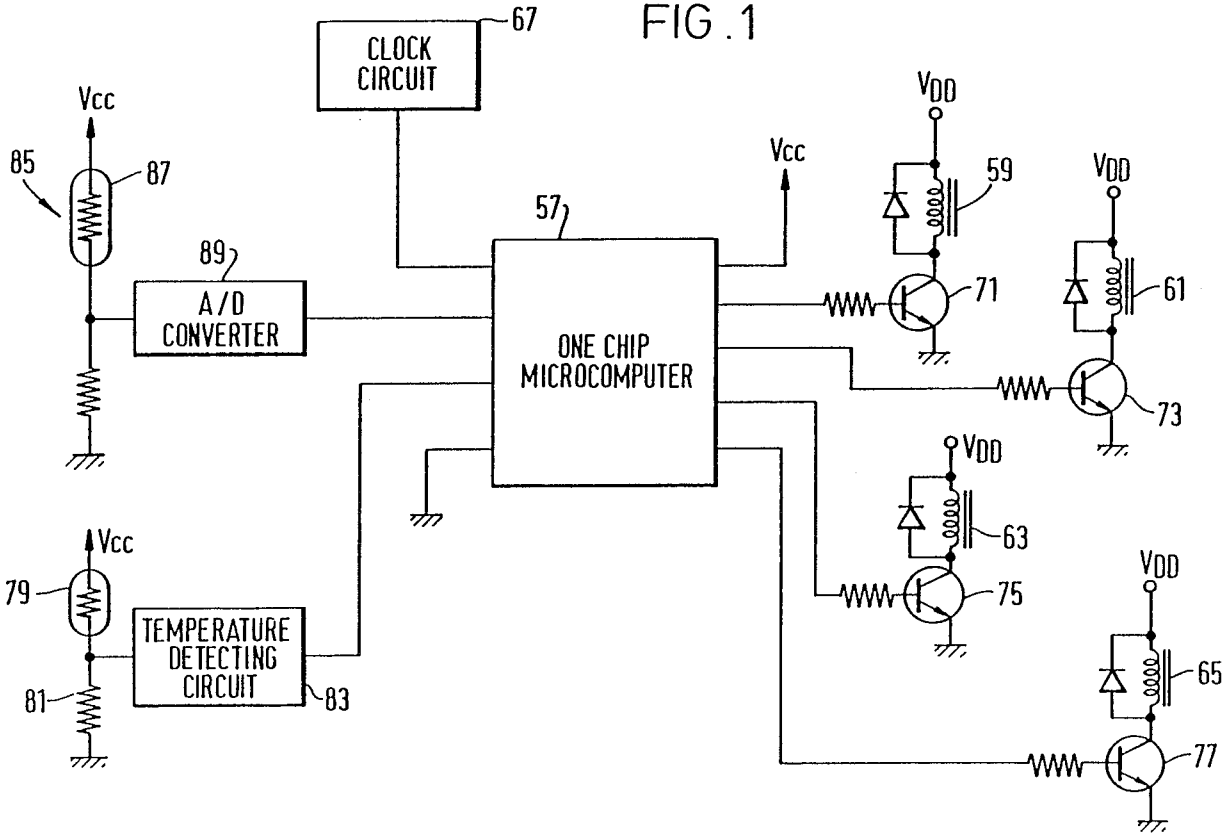
FIG. 1 is a schematic circuit diagram of significant portions of a control circuit according to an embodiment of the present invention.

FIG. 1, shows significant portions of the control circuit of the refrigerator according to the present invention. A single chip miorocomputer 57 executes programs stored in a ROM (not shown), and controls energization and deenergization of relays 59, 61, 63, 65 in accordance with output timing signals from a clock circuit 67, a signal from a room temperature detection circuit 69, etc. Providing "high" logic signals to the bases of transistors 71 to 77, respectively connected to the relays 59 to 65, results in energization of relays 59 to 65, respectively. When first relay 59 is energized, a contact (not shown) is closed and as a result the compressor 43 is actuated by a commercial power supply or an invertor device outputting, e.g., 120 Hz AC power. When the second relay 61 is energized, a contact (not shown) is closed and as a result power is supplied to the electromagnetic valve 41, causing it to assume a position permitting movement of operating fluid in thermosiphon 39 and heat exchange between the cold-accumulation material 35 and the main evaporator 23. When the third relay 63 is energized, a contact (not shown) is closed and as a result, power is supplied to the valve 49, whereby a switch from a first flowpath for ordinary cooling operation (first mode) to a second flowpath for the cold-accumulation operation. When the fourth relay 65 is energized, a contact (not shown) is closed, and as a result the cold air circulation fan 31 is actuated, whereby cold air is circulated in the compartments. A freezer sensor 79, as is well known, comprises a thermistor having negative temperature coefficient. One end of the freezer sensor 79 is connected to a D.C. power supply Vcc and the other end is connected to ground through a resistor 81. A connection point between the freezer sensor 79 and the resistor 81 is connected to a temperature detecting circuit 83. When the compartment interior temperature detection by the freezer sensor 79 rises above a prescribed level, such as, e.g., −19° C., the temperature detection circuit 83 outputs a "high" logic signal to one of the input ports of the microcomputer 57, and ordinary cooling operation or cold-accumulation material cooling operation is carried out. A room temperature detection circuit 85 includes a room temperature sensor 87 and an A/D converter 89. The room temperature sensor 87 is preferably a thermistor having negative temperature coefficient which detects the ambient room temperature. A/D converter 89 digitizes an output analog voltage from the room temperature sensor 87, and provides it to one of the input ports of the microcomputer 57.

First Mode Operation (ordinary cooling):

Ordinary cooling is carried out by causing compressor 43 to supply refrigerant to the main evaporator 23. Power to the second relay 61 and the third relay 63 is cut-off by the microcomputer 57 which causes a "low" signal to be provided to the bases of the second transistor 73 and third transistor 75, whereby the electromagnetic valve 41 is closed, and the electromagnetic valve 49 is deactivated. As a result, thermosiphon 39 ceases to operate. The refrigerant flowpath in the refrigerating cycle is switched to the ordinary cooling operation flowpath. When the temperature in the freezing compartment 9 rises, and the temperature detecting circuit 83 outputs a "high" signal to one of the input ports of the microcomputer 57, the first relay 59 and the forth relay 65 are energized by the microcomputer 57 causing "high" signals to be provided to the bases of the first transistor 71 and the forth transistor 77. As the first relay 59 and the fourth relay 65 are energized, the compressor 43 and the cold air circulation fan 31 are actuated by a commercial power supply. As a result, refrigerant is supplied to the main evaporator 23 and cold air produced thereby is circulated by the cold air circulation fan 31 to cool the refrigerator compartments. When the temperature in the freezing compartment 9 falls to the prescribed value, the "high" signal from the temperature detecting circuit 83 is cut off, and the first relay 59 and the fourth relay 65 are deenergized by the microcomputer 57. The "high" signals are no longer applied to the bases of the first transistor 71 and the fourth transistor 77. As a result, ordinary cooling operation is stopped. In this manner, the interior temperature of compartments are individually kept below a set temperature by the ordinary cooling operation.

Second Mode Operation:

In second mode operation, the refrigerator compartments are cooled by means of the cold-accumulation material. Heat is exchanged between the cold-accumulation material 35 and the main evaporator 23. Power to the first relay 59 is cut off by the microcomputer 57 by outputting a "low" signal to the base of the first transistor 71 and power to the third relay 63 is supplied by the microcomputer 57 causing a "high" signal to be provided to the base of the third transistor 75, whereby the compressor 43 is maintained deactuated and the valve 49 is activated. As a result, the refrigerant flowpath in the refrigerating cycle is switched from the flowpath for the ordinary cooling operation to the flowpath for cold-accumulation operation.

When the temperature in the freezing compartment 9 rises, and the temperature detecting circuit 83 outputs a "high" signal to one of the input ports of the microcomputer 57, power is supplied to the second relay 61 and the fourth relay 65 when microcomputer 57 outputting H-level signals to the bases of the second transistor 73 and the fourth transistor 77. When the second relay 61 and the fourth relay 65 are energized, the electromagnetic valve 41 is opened and the cold air circulation fan 31 is actuated by the commercial power supply.

As a result, heat exchange between the main evaporator 23 and the cold-accumulation material 35 is permitted. An operating fluid, preferably a refrigerant but not necessarily so, enclosed in the pipeline of the thermosiphon 39 absorbs heat from the main evaporator 23, where the operating fluid is evaporated from a liquid state to a gas state. The gas passes along the pipeline of the thermosiphon 39, and rises to the cold-accumulation material 35 section, wherein the operating fluid gas is cooled and condenses to a liquid, and then travels along the pipeline to return to the main evaporator 23. There, the operating fluid again absorbs heat of the freezer interior. Cold air produced by the main evaporator 23 is circulated by the cold air circulation fan 31, thereby cooling the refrigerator compartments. When the temperature in the freezing compartment 9 falls to the prescribed value, such as, e.g., −22° C., the "high" signal from the temperature detecting circuit 83 is cut off, and the second relay 61 and the fourth relay 65 are deenergized by the microcomputer 57 by its causing the "high" signals to be removed from the bases of the second transistor 73 and the fourth transistor 77. As a result, the electromagnetic value 41 is closed, the cold air circulation fan is deactuated, and cooling by means of the cold-accumulation material ceases. In this manner, the interior of compartments are individually kept below the set temperature by the cold-accumulation material cooling operation. As made clear below, the cold-accumulation material cooling operation can be performed only during a set time band in the daytime.

Third Mode:

In third mode operation, the cold-accumulation material is cooled by supplying refrigerant to the cold-accumulation evaporator 37 during a predetermined time interval (usually at night) when power demand is low. Power to the second relay 61 is cut off by microcomputer 57 causing a "low" signal to be applied to the base of the second transistor 73. Power to the third relay 63 is supplied by the microcomputer 57 causing a "high" signal to be applied to the base of the third transistor 75. When the second relay 61 is denergized, and the third relay 63 is energized and valve 49 is activated. As a result, the refrigerant flowpath is switched from the flowpath for the ordinary cooling operation to the flowpath for the cold-accumulation operation. While these conditions exist, microcomputer 57 causes a "high" signal to be applied to the base of the first transistor 71 which, in turn, causes the first relay 59 to be energized. This couples compressor 43 to an invertor unit (not shown) outputting 720 Hz AC power which causes the compressor to be operated at a higher capacity than it would otherwise operate with when connected to an ordinary commercial power supply. Refrigerant is supplied to the cold-accumulation evaporator 37, whereby the cold-accumulation evaporator 37 and hence cold-accumulation material 35 are cooled. During this cold-accumulation operation, if the interior temperature of compartments rises above the prescribed valve, the cold-accumulation operation is temporarily halted and the above-described ordinary cooling operation is effected to cool the compartment interiors.

The cooling capacity of the cold-accumulation material 35 is such that it is sufficient even if the cold-accumulation material cooling operation is carried out frequently in high-temperature situations as in summer, etc. Consequently, the cooling capacity of the cold-accumulation material 35 tends to be excessive at times of low-temperature when the frequency of execution of the cold-accumulation material cooling operation is less. In this embodiment, therefore, the arrangement is as follows.

Figure 6:
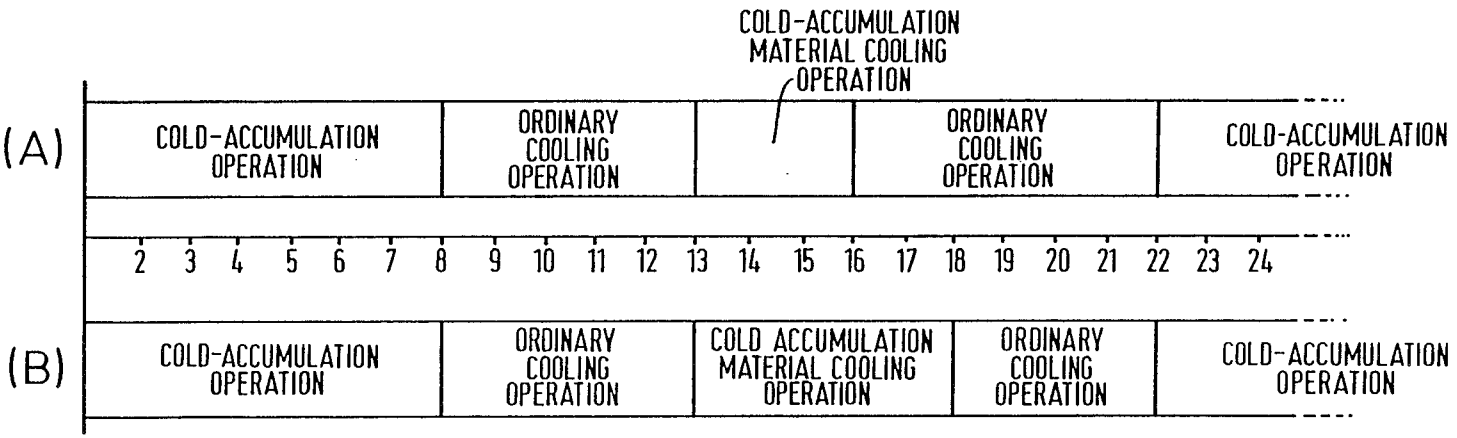
FIG. 6 is a graphical representation explaining an operation of the present invention.

As is shown in FIG. 6, the microcomputer 57 effects control such that in the period from 8:00 a.m. to 1:00 p.m. the compartment interior is cooled by the above-described ordinary cooling operation when the compartment interior temperature rises above the prescribed valve. Further, control is such that in the period from 1:00 p.m. to 4:00 p.m., the compartment interior is cooled by the above-described cold-accumulation material cooling operation when the compartment interior temperature rises above the prescribed valve. Also, from 1:00 p.m. to 4:00 p.m. the average room temperature is calculated. If the average room temperature from 1:00 p.m. to 4:00 p.m. is, e.g., 15° C. or more, execution of the ordinary cooling operation instead of the cold-accumulation material cooling operation is made possible, as indicated in FIG. 6-(A). In this case, if the average room temperature from 1:00 p.m. to 4:00 p.m. is 15° C. or more, the time band in which the cold-accumulation material cooling operation is performable is the time band from 1:00 p.m. to 4:00 p.m. Subsequently, during the period from 4:00 p.m. to 10:00 p.m., ordinary cooling is carried out. During the period from 10:00 p.m. to 8:00 a.m. on next day cold-accumulation operation is executed.

However, if the average room temperature during 1:00 p.m. to 4:00 p.m. is, e.g., less than 15° C., the microcomputer 57 extends the time band in which the cold-accumulation material cooling operation is performable, making an adjustment so that it lasts up to, for example, 6:00 p.m., as indicated in section B of FIG. 6. In this case, if the average room temperature from 1:00 p.m. to 4:00 p.m. is less than 15° C., the time band in which the cold-accumulation material cooling operation is performable is the time band from 1:00 p.m. to 6:00 p.m. of a day. Subsequently, during the period from 6:00 p.m. to 10:00 p.m., ordinary cooling takes place. During the period from 10:00 p.m. to 8:00 a.m. on the next day, the cold-accumulation material is cooled.

If, for example, the average room temperature from 1:00 p.m. to 4:00 p.m. is lower than 15° C., the time band in which cooling by means of the cold-accumulation material is extended by 2 hours. The cold-accumulation material 35 which, at 4:00 p.m., still has remaining cooling capacity because of the low room temperature can still exchange heat with the main evaporator 23 through the thermosiphon 39. Thus, the cooling capacity of the cold-accumulation material is put to effect use. The cooling of the cold accumulation material is delayed so that more of the cooling capacity of the cold-accumulation material 35 can be used. The cold accumulation material is not so much needlessly cooled and power is not wasted.

The present invention has been described with respect to a specific embodiment. However, other embodiments based on the principles of the present invention should be obvious to those of ordinary skill in the art. For example, when the time band for effecting the cold-accumulation material cooling operation is extended, in order to still further ensure refrigerator compartment cooling in the extended time band, a cold-accumulation material temperature sensor may be provided near the cold-accumulation material to sense the cold-accumulation material cooling capacity. Changeover to permit refrigerator compartment by the ordinary cooling operation is made if the detected cooling capacity is insufficient. Such embodiments are intended to be covered by the claims.

What is claimed is:

1. A refrigerator having a compartment, comprising:

a cold accumulation material;

a refrigerating cycle for cooling said compartment and the cold-accumulation material;

means for cooling said compartment by heat transfer between said compartment and said cold-accumulation material;

load detecting means for measuring an amount of a load to be cooled;

clock counting means for generating time data; and control means for causing said refrigerator to operate in accordance with first, second and third modes of operation wherein in said first mode said refrigerator compartment is cooled by the refrigerating cycle, wherein in said second mode said compartment is cooled by the cold-accumulation material, and wherein in said third mode the cold-accumulation material is cooled by the refrigerating cycle, said modes being carried out in accordance with said time data, the second mode operation having a time duration that is a function of load as determined by the load detecting means.

2. A refrigerator according to claim 1, wherein the refrigerating cycle comprises:

a compressor for compressing refrigerant;

a first ordinary refrigerant flowpath utilizing refrigerant compressed by said compressor to cool said compartment during first mode operation;

a second cold-accumulation refrigerant flowpath utilizing refrigerant compressed by the compressor to cool the cold-accumulation material during third mode operation;

a heat transfer means for cooling said compartment by the cold-accumulation material during second mode operation when the compressor is not being operated; and flowpath switching means, responsive to the control means, for selecting either the first or second flowpath.

3. A refrigerator according to claim 2, wherein the second refrigerant flowpath includes a cold-accumulation evaporator having heat exchangeable relation to the cold-accumulation material.

4. A refrigerator according to claim 3, wherein the first flowpath includes an evaporator for generator cold air, the evaporator being provided below the cold accumulation evaporator.

5. A refrigerator according to claim 4, wherein the heat transfer means includes a thermosiphon connected with the evaporator and the cold-accumulation evaporator for exchanging heat between the evaporator and the cold-accumulation material.

6. A refrigerator according to claim 5, wherein the thermosiphon includes an electromagnetic valve operable responsive to said control means.

7. A refrigerator according to claim 6, wherein the flowpath switching means includes a flowpath switching type electromagnetic valve operable responsive to said control means.

8. A refrigerator according to claim 2, wherein the load detecting means includes room temperature detecting means for measuring the temperature of a room in which the refrigerator is placed.

9. A refrigerator according to claim 8, wherein the room temperature detecting means includes a thermistor thermal sensor and an A/D converter connected thereto.

10. A refrigerator according to claim 8, wherein the cold-accumulation evaporator has a heat exchangeable relation to the cold-accumulation material.

11. A refrigerator according to claim 10, wherein the ordinary refrigerant flowpath includes an evaporator for generating cold air, the evaporator being provided below the cold-accumulation evaporator.

12. A refrigerator according to claim 11, wherein the heat transfer means includes a thermosiphon connected with the evaporator and the cold-accumulation evaporator for exchanging heat between the evaporator and the cold-accumulation material.

13. A refrigerator according to claim 12, wherein the thermosiphon includes an electromagnetic valve operable responsive to said control means.

14. A refrigerator according to claim 13, wherein the flowpath switching means includes a flowpath switching type electromagnetic valve operable responsive to said control means.

* * * * *